US008638538B2

(12) United States Patent
DeVarney et al.

(10) Patent No.: US 8,638,538 B2
(45) Date of Patent: Jan. 28, 2014

(54) LOW ENERGY ELECTROMAGNETIC RELAY

(75) Inventors: Craig N. DeVarney, Essex Junction, VT (US); Scott T. DeVarney, Essex Junction, VT (US)

(73) Assignee: International Business Machines Corporation, Armonk, NY (US)

( * ) Notice: Subject to any disclaimer, the term of this patent is extended or adjusted under 35 U.S.C. 154(b) by 444 days.

(21) Appl. No.: 13/012,147

(22) Filed: Jan. 24, 2011

(65) Prior Publication Data

US 2012/0188679 A1 Jul. 26, 2012

(51) Int. Cl.
*H01H 47/00* (2006.01)

(52) U.S. Cl.
USPC ..... 361/160

(58) Field of Classification Search
USPC ..... 361/160
See application file for complete search history.

(56) References Cited

U.S. PATENT DOCUMENTS

| | | | | |
|---|---|---|---|---|
| 4,013,931 | A | 3/1977 | de Fligue et al. | |
| 5,040,089 | A * | 8/1991 | Sasaki | 361/160 |
| 6,233,132 | B1 | 5/2001 | Jenski | |
| 8,040,654 | B2 * | 10/2011 | Lenz | 361/160 |

* cited by examiner

*Primary Examiner* — Stephen W Jackson
(74) *Attorney, Agent, or Firm* — Schmeiser, Olsen & Watts; Anthony Canale

(57) ABSTRACT

A low energy electromagnetic relay and method of reducing power consumption in electromagnetic relays. The electromagnetic relay includes an electrical coil having a first end connected to a first contact and a second end connected to first side of a normally closed switch, a second side of the switch connected to a second contact; a resistor connected between the first end of the coil and the second contact; and an armature configured to move to an actuated position and open the first switch when power is applied across the first and the second contacts.

26 Claims, 3 Drawing Sheets

LOW ENERGY ELECTROMAGNETIC RELAY

FIELD OF THE INVENTION

The present invention relates to the field of electromagnetic relays; more specifically, it relates to electromagnetic relays with reduced power consumption and methods of reducing power consumption in electromagnetic relays.

BACKGROUND

The coil of electromagnetic relays can consume relatively large amounts of power when powered. Various methods currently employed to reduce power consumption are mechanically complex or require complex power control circuits external to the relay. Accordingly, there exists a need in the art to mitigate the deficiencies and limitations described hereinabove.

SUMMARY

A first aspect of the present invention is a device, comprising: an electrical coil having a first end connected to a first contact and a second end connected to first side of a normally closed switch, a second side of the switch connected to a second contact; a resistor connected between the first end of the coil and the second contact; and an armature configured to move to an actuated position and open the first switch when power is applied across the first and the second contacts.

A second aspect of the present invention is a method, comprising: applying power to a coil of an electro-mechanical actuator through a normally closed switch; the actuator opening the normally closed switch so all power to the coil is supplied through a resistor connected between the normally closed switch and the coil; maintaining the switch in the open position as long as power is applied to the coil through the resistor; and returning the switch to the closed position when power is turned off to the coil.

These and other aspects of the invention are described below.

BRIEF DESCRIPTION OF THE DRAWINGS

The features of the invention are set forth in the appended claims. The invention itself, however, will be best understood by reference to the following detailed description of an illustrative embodiment when read in conjunction with the accompanying drawings, wherein:

DETAILED DESCRIPTION

Electromagnetic relays of the embodiments of the present invention utilize a resistor in series with the coil of the relay and a normally closed switch in parallel with the resistor to reduce power consumption of the coil when the coil is powered. Initially power is applied to the coil both directly and also through the resistor. This opens the switch, so power to the coil is then supplied only through the resistor. When power is turned off, the switch resets.

Figure 1A:
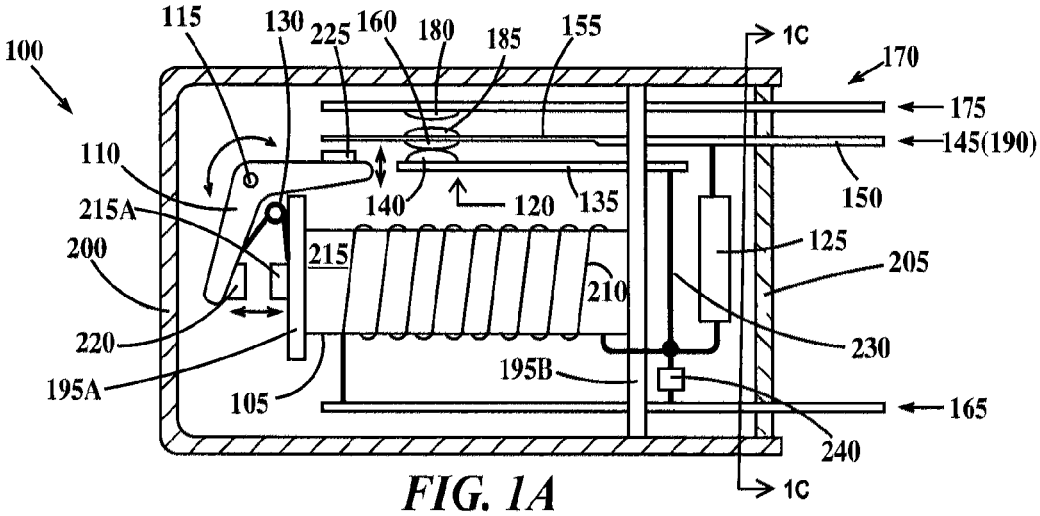
FIG. 1A is a side view partly in section illustrating an exemplary electromagnetic relay assembly according to an embodiment of the present invention.
Figure 1B:
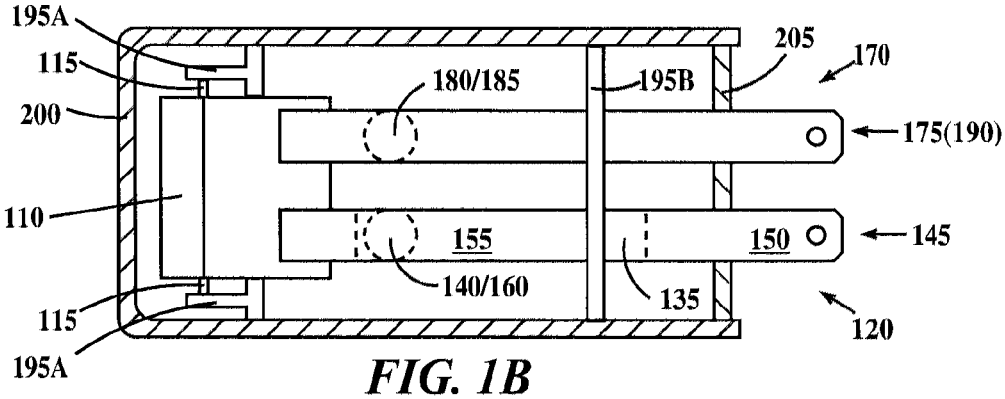
FIG. 1B is a top view partly in section of the exemplary electromagnetic relay assembly of FIG. 1A.

FIG. 1A is a side view partly in section illustrating an exemplary electromagnetic relay assembly according to an embodiment of the present invention. In FIG. 1A, a relay assembly 100 includes a coil assembly 105, an armature 110 (which can pivot about a pivot 115), a first switch 120, a resistor 125 and a spring 130. First switch 120 includes a electrically conductive and rigid first contact strip 135 having an electrically conductive first contact 140 physically and electrically attached and an electrically conductive second contact strip 145 having rigid portion 150 and a flexible portion 155. An electrically conductive second contact is 160 is electrically and physically attached to flexible portion 155. Second contact 160 is positioned opposite first contact 140. Second contact strip 145 and a third contact strip 165 are the power supply inputs to coil assembly 105. First switch 120 is a normally closed (NC) switch and FIG. 1A depicts relay assembly 105 in the off state with contacts 140 and 160 in physical and electrical contact. Relay assembly also includes a second switch 170, which is illustrated in FIGS. 1A, 1B and 1E and described in detail infra with respect to FIG. 1E. FIG. 1B is a top view partly in section of the exemplary electromagnetic relay assembly of FIG. 1A.

First, second, third, fourth and fifth contact strips 135, 145, 165, 175 and 190 coil assembly 105 and armature 110 are held in position in a housing 200 by dielectric supports 195A and 195B. Second, third, fourth and fifth contact strips, 145, 165, 175 and 190 extend through a dielectric base 205 which seals (optionally hermetically seals) the relay assembly 100. First contact strip 135 is connected directly (by electrically conductive wire 230) to a first end of an electrically conductive wire coil 210 wound around a dielectric tube containing a core 215. (If an insulated wire is used to make coil 210, dielectric tube may be eliminated.) Third contact strip 165 is electrically connected to a second and opposite end of coil 210. Resistor 125 is electrically connected between second contact strip 145 and the first end of coil 210. In one example, core 215A is formed from a ferromagnetic material. Suitable resistor types for resistor 125 include but are not limited to carbon composite resistors, thin film resistors and wire-wound resistors.

When power is supplied across second and third contact strips 145 and 165 coil 210 current flow is through contract strip 145, contact 160, contact 140 and contact strip 135 thereby magnetizing core 215 and attracting button 220 to a protruding portion 215A of core 215 causing armature 110 to rotate in the counter-clockwise direction. Rotation of armature 110 causes dielectric button 225 to physically contact and push on flexible portion 155 of contact strip 145 forcing contacts 140 and 160 apart as well as compressing spring 130. Note, in the example of FIG. 1, contacts 180 and 185 will be forced together into physical and electrical contact. When contacts 140 and 160 are forced apart, current flow is only though contact strip 145 and resistor 125 to coil 210. The resistance value of resistor 125 is selected so sufficient current is supplied to coil 210 to keep button 220 attracted to core 215A and contacts 140 and 160 apart. Because the power supply voltage to coil 210 now passes through resistor 125, the amount of current through coil 210 is reduced thus saving power. When power to second and third contact strips 145 and 165 are turned off, spring 130 rotates armature 110 clockwise resetting first and second switches 120 and 170 to their original states.

When relay assembly 100 is designed for a direct current (DC) power supply, optional diode 240 may be electrically connected between the first and of coil 210 and second contact strip 165 for arc suppression across first and second contacts 140 and 160. (See also FIGS. 2A and 2B.) When relay assembly 100 is designed for an alternating current (AC) power supply, no diode is required.

FIG. 1B is a top view partly in section of the exemplary electromagnetic relay assembly of FIG. 1A. FIG. 1B illustrates that switches 120 and 170 are located next to one another. The straight dashed lines illustrate the ends of first contact strip 135 and the dashed circles the first, second, third and fourth contacts 140, 160, 180 and 185.

Figure 1C:
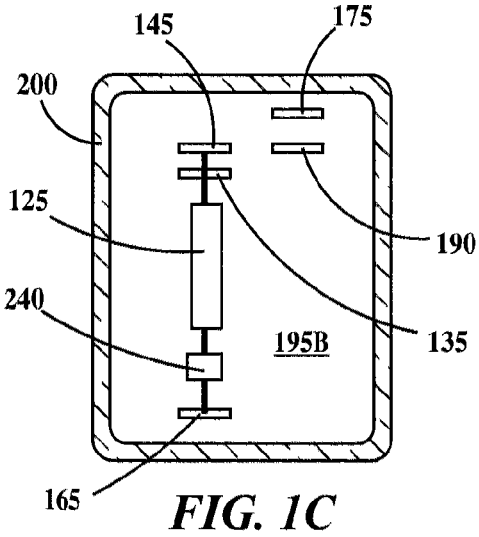
FIG. 1C is an end view partly in section through line 1C-1C of FIG. 1A of the exemplary electromagnetic relay assembly of FIG. 1A.

FIG. 1C is an end view partly in section through line 1C-1C of FIG. 1A of the exemplary electromagnetic relay assembly of FIG. 1A. In FIG. 1C, the relative positions of resistor 125, first, second, third, fourth and fifth contact strips 135, 145, 165, 175 and 190 and optional diode 240 within housing 200 are illustrated.

Figure 1D:
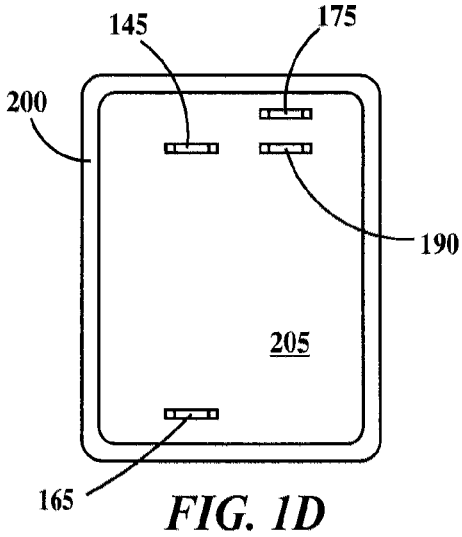
FIG. 1D is an end view partly in section of the exemplary electromagnetic relay assembly of FIG. 1A.
Figure 1E:
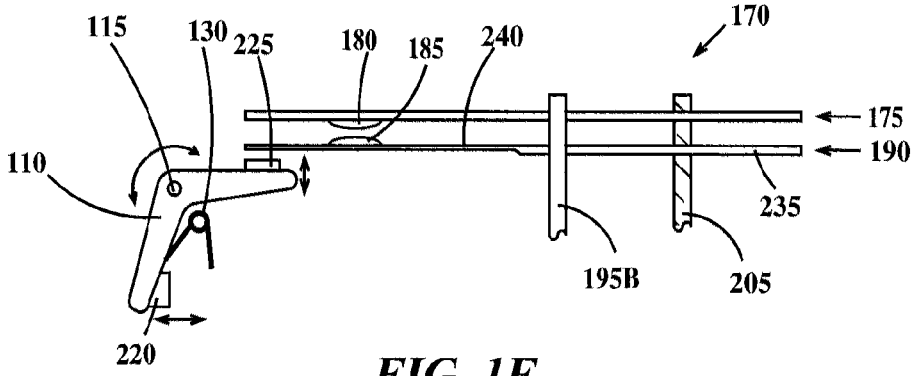
FIG. 1E illustrates the functional switch of the exemplary electromagnetic relay assembly of FIG. 1A.

FIG. 1D is an end view partly in section of the exemplary electromagnetic relay assembly of FIG. 1A. In FIG. 1D, the relative positions of second, third, fourth and fifth contact strips 145, 165, 175 and 190 external to housing 200.

FIG. 1E illustrates the functional switch of the exemplary electromagnetic relay assembly of FIG. 1A. Second switch 170 includes a electrically conductive and rigid fourth contact strip 175 having an electrically conductive third contact 180 physically and electrically attached and an electrically conductive fifth contact strip 190 (see also FIG. 1E) having rigid portion 235 and a flexible portion 240. An electrically conductive fourth contact is 185 is physically and electrically attached to flexible portion 240. Fourth contact 185 is positioned opposite third contact 180. Fourth contact strip 175 and a fifth contact strip 190 are switch inputs to switch 170. Second switch 170 is a normally open (NO) switch.

Figure 2A:
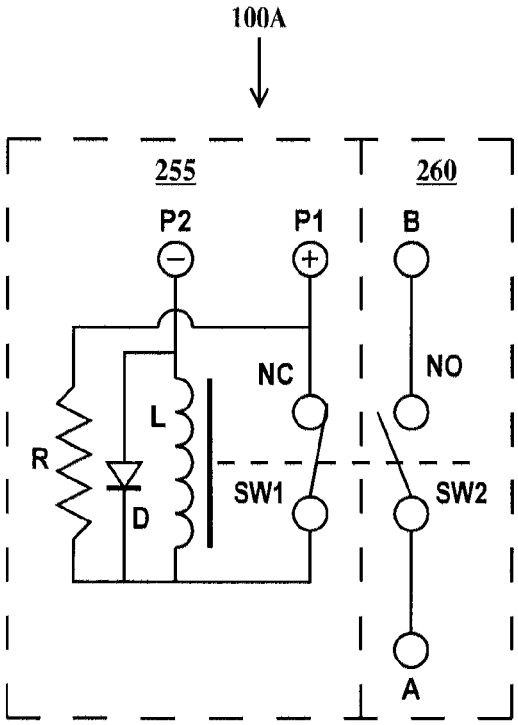
FIG. 2A is a schematic circuit diagram of the exemplary electromagnetic relay of FIGS. 1A through 1E with no power applied to the coil of the relay.

FIG. 2A is a schematic circuit diagram of the exemplary electromagnetic relay of FIGS. 1A through 1E with no power applied to the coil of the relay. In FIG. 2A, an electromagnetic relay 100A includes a solenoid section 255 and a switch section 260. Solenoid section 255 includes resistor R, optional diode D, coil L, a NC single-pole single throw (SPST) switch SW1 and power terminals P1 and P2. The coil L, the heavy vertical line and the horizontal small dashed line through switches SW1 and SW2 represent an electro-mechanical actuator. Power terminal P1 is electrically connected to a first end of resistor R and to a first terminal of switch SW1. Power terminal P2 is electrically connected to a first end of coil L. The second end of resistor R, the second end of coil L and the second terminal of SW1 are electrically connected to each other. Switch section 260 includes a NO SPST switch SW2. Resistor R is electrically connected in parallel with switch SW1. Switch SW2 includes an input terminal A and an output terminal B. Switches SW1 and SW2 are ganged together so both switches change state when power is applied to coil L. The type of switch illustrated for switch SW2 is exemplary. If the power supply is DC, then P1 is electrically connected to the positive side of the power supply and P2 is electrically connected to the negative side of the power supply. The anode of an optional diode D is electrically connected to terminal P2 and the cathode of diode D is electrically connected to the second terminal of switch SW2. Diode D is electrically connected in parallel with coil L.

With no power applied SW1 is closed and switch SW2 is open. When power is applied to terminals P1 and P2 current flow is instantaneously through coil L and switch SW1. If the resistance of coil L is Rc then the current through coil L is given by Ii=V/Rc where Ii is the initial current through coil L and V is the power supply voltage. Thus FIG. 2A also illustrates the state of relay 100A with no power applied and immediately (or instantaneously) after power is supplied to the coil of the relay. However, since applying power to the coil, causes SW1 to change state (from closed to open) the maintaining current flow Im through coil L is determined from FIG. 2B.

Figure 2B:
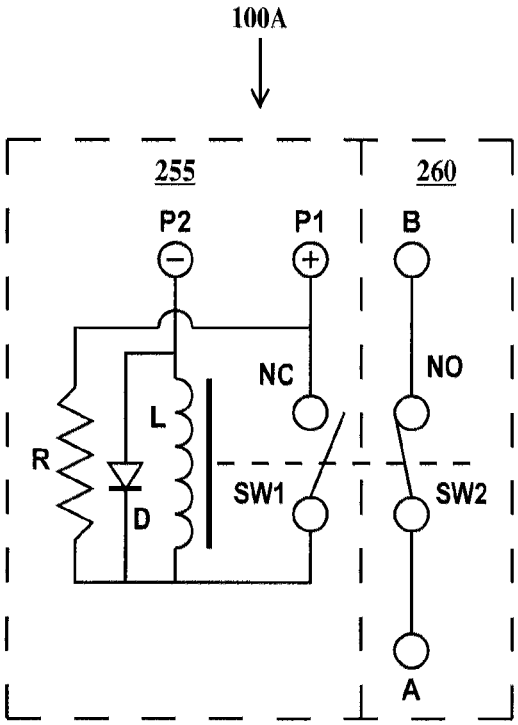
FIG. 2B is a schematic circuit diagram of the exemplary electromagnetic relay of FIGS. 1A through 1E while power is applied to the coil of the relay.

FIG. 2B is a schematic circuit diagram of the exemplary electromagnetic relay of FIGS. 1A through 1E while power is applied to the coil of the relay. The difference between FIG. 2A and FIG. 2B is SW1 is open in FIG. 2B (it was closed in FIG. 2A) and SW2 is closed in FIG. 2B (it was opened in FIG. 2A). If the resistance of resistor R is Rr then the current through coil L is given by Im=V/(Rc+Rr) where Im is the maintaining current through coil L and V is the power supply voltage since the resistor R and coil L are in series. Comparing the equations for Ii and Im it is clear that Im must be less than Ii. It should also be understood that, in general, a higher voltage must be applied to coil L to initially activate the solenoid then that current required to maintain the solenoid in the activated state.

Taking an example, assume a relay designed for a 12 volt DC power supply having a 500 ohm coil and a 250 ohm resistor. It will take about 10 volts to activate the solenoid initially. After SW1 opens it will take about six to about eight volts to maintain the solenoid in the active state. Ii=12 v/500 ohm=24 ma. Im=12 v/(500 ohm+250 ohm)=16 ma which is about a 30% savings on power consumption. In one example, it is preferred that electromagnetic relays according to embodiments of the present invention have a resistor whose resistance that is about ⅓ the resistance of the coil. In one example, it is preferred that electromagnetic relays according to embodiments of the have a resistor whose resistance is between about ⅕ and about ⅖ the resistance of the coil. When the resistance of the resistor is less than about ⅕ that of the coil, not very much power is saved. When the resistance of the resistor is greater than about ⅖ that of the coil, the solenoid is likely to "chatter" because the maintenance voltage being dropped across the coil is insufficient to generate a strong enough magnetic field in the core to overcome the force of the spring. Chatter occurs when switch SW1 continuously cycles between closed and open while power is supplied to the solenoid section.

In summary the operation of the solenoid sections of electromagnetic relays according to embodiments of the present invention is as follows:

1. Power is applied to the coil through the normally closed switch.
2. The powered coil electro-mechanically opens the normally closed switch so all power to the coil is then supplied through the resistor connected to the hot side of the normally closed switch.
3. The switch is electro-mechanically maintained in the open state (e.g., latched) as long as power is applied.
4. When power is turned off, the normally closed switch mechanically returns to the closed state.

Figure 3:
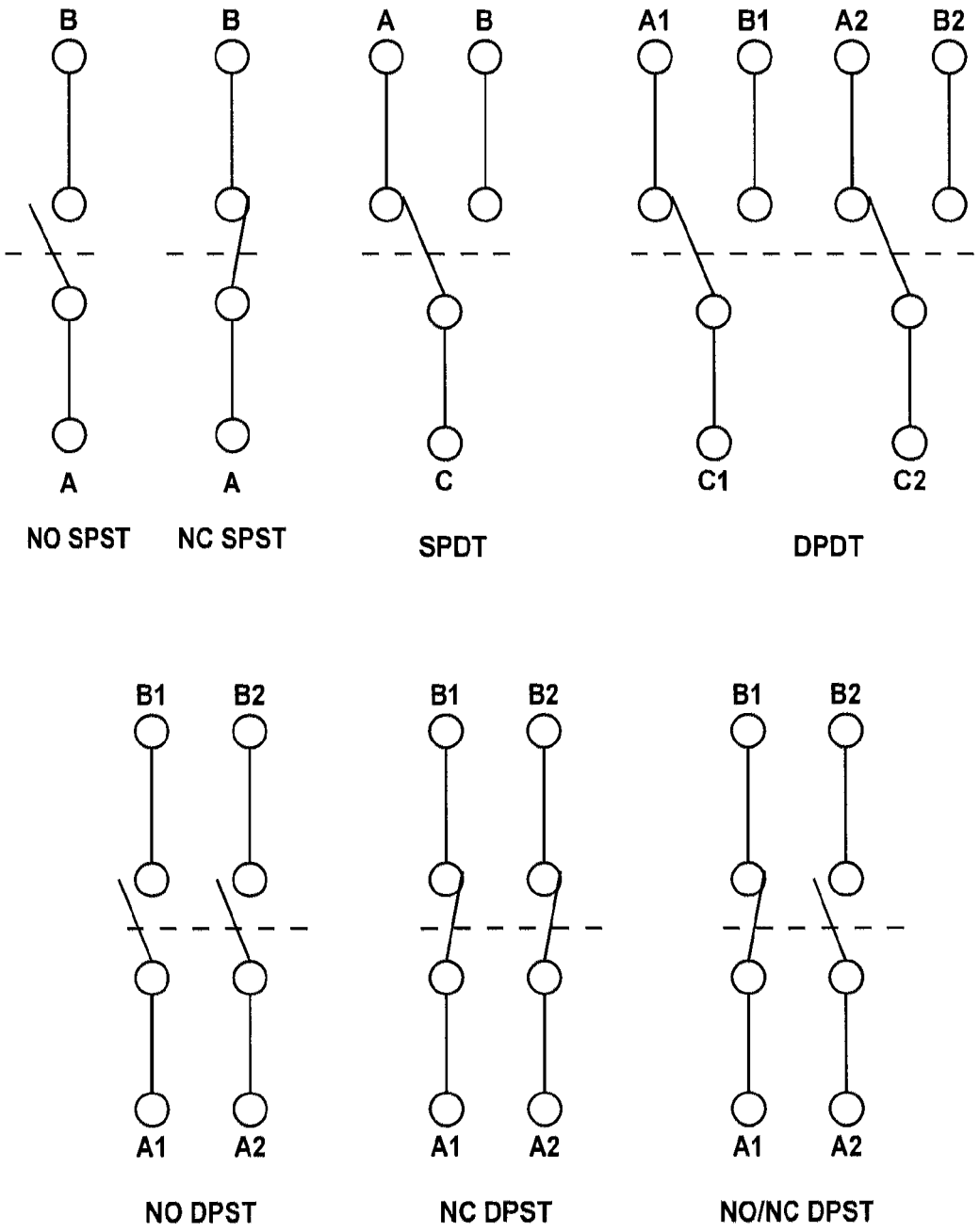
FIG. 3 illustrates exemplary switchable elements that may be used in electromagnetic relays according to embodiments of the present invention.

FIG. 3 illustrates exemplary switchable elements that may be used in electromagnetic relays according to embodiments of the present invention. FIG. 3 illustrates seven types of switches that may be used for SW2 of switch section 260 of FIGS. 2A and 2B. A first type of switch is a NO SPST switch having an input A and an output B. This is the type of switch illustrated in FIGS. 1A, 1E, 2A and 2B. A second type of switch is a NC SPST witch having an input A and an output B. A third type of switch is a single pole double throw switch having an input C, a first output A and a second output B. A fourth type of switch is a NO double pole single throw (DPST) switch having a first input A1 and corresponding first output B1 and a second input A2 and corresponding second output B2. A fifth type of switch is a NC DPST switch having a first input A1 and corresponding first output B1 and a second input A2 and corresponding second output B2. A sixth type of switch is a NO/NC DPST switch having a first input A1 and corresponding first output B1 and a second input A2 and corresponding second output B2. A seventh type of switch is a double pole double throw (DPDT) switch having an first input C1, corresponding first and second outputs A1 and B1 and n second input C2, corresponding third and fourth outputs A2 and B2. Double throw switches may come in break-before-make or make-before-break types. When the SPDT switch illustrated is a make-before-break switch, input C is connected to output B before being disconnected from output A. When the SPDT switch illustrated is a break-before-make switch, input C is disconnected from output A before being connected to output B. Similarly, each side of the DPDT switch illustrated may be independently a break-before-make or make-before-break type.

Thus the embodiments of the present invention provide electromagnetic relays with reduced power consumption and methods of reducing power consumption in electromagnetic relays.

The description of the embodiments of the present invention is given above for the understanding of the present invention. It will be understood that the invention is not limited to the particular embodiments described herein, but is capable of various modifications, rearrangements and substitutions as will now become apparent to those skilled in the art without departing from the scope of the invention. Therefore, it is intended that the following claims cover all such modifications and changes as fall within the true spirit and scope of the invention.

What is claimed is:

1. A device, comprising:

an electrical coil having a first end connected to a first contact and a second end connected to first side of a normally closed switch having only two positions, a fully open position and a fully closed position, a second side of said switch directly connected to a second contact;

a resistor having a first end connected to said second end of said coil and to said first side of said switch, and having a second end directly connected to said second contact and to said second side of said switch, said resistor connected to said second contact only when said switch is in said closed position; and an armature configured to move to an actuated position and open said switch when power is applied across said first and said second contacts.

2. The device of claim 1, wherein when said armature is in said actuated position power is supplied to said coil only through said resistor.

3. The device of claim 1, wherein when no power is applied across said first and second contacts said armature is in a deactivated position and said switch is closed.

4. The device of claim 1, further including:

a spring configured to push said armature to a deactivated position when no power is applied across said first and second contacts.

5. The device of claim 1, wherein a resistance value of said resistor is about ⅓ of a resistance value of said coil.

6. The device of claim 1, wherein a resistance value of said resistor is between about ⅕ and about ⅖ of a resistance value of said coil.

7. The device of claim 1, further including:

a diode connected in parallel with said coil.

8. The device of claim 1, further including:

an additional switch configured to be operated by said armature.

9. The device of claim 8, wherein said additional switch is selected from the group consisting of normally open single-pole single throw switches, normally closed single-pole single throw switches, single-pole double throw switches, double-pole double throw switches, double-pole single throw switches and combinations thereof.

10. The device of claim 1, wherein said resistor is selected from the group consisting of carbon composite resistors, thin film resistors and wire-wound resistors.

11. A method, comprising:

providing an electromagnetic actuator comprising:

an electrical coil having a first end connected to a first contact and a second end connected to first side of a normally closed switch having only two positions, a fully open position and a fully closed position, a second side of said switch directly connected to a second contact;

a resistor having a first end connected to said second end of said coil and to said first side of said switch, and having a second end directly connected to said second contact and to said second side of said switch, said resistor connected to said second contact only when said switch is in a said closed position; and an armature configured to move to an actuated position and open said switch when power is applied across said first and said second contacts;

applying power across said first and second contacts, said switch in said closed position;

upon said application of said power said armature moving said switch to said open position of said only two positions wherein power to said coil is supplied only through said resistor;

maintaining said switch in said open position of said only two positions as long as power is applied to said coil through said resistor; and returning said switch to said closed position of said only two positions when said power is turned off to said coil.

12. The method of claim 11, wherein said returning said switch to the closed position is performed by a spring pushing on said armature.

13. The method of claim 11, wherein a resistance value of said resistor is about ⅓ of a resistance value of said coil.

14. The method of claim 11, wherein a resistance value of said resistor is between about ⅕ and about ⅖ of a resistance value of said coil.

15. The method of claim 11, including:

said armature operating an additional switch.

16. The method of claim 15, wherein said additional switch is selected from the group consisting of normally open single-pole single throw switches, normally closed single-pole single throw switches, single-pole double throw switches, double-pole double throw switches, double-pole single throw switches and combinations thereof.

17. The method of claim 11, wherein a first value of a current through said coil with power supplied to said coil when said switch is closed is greater than a second value of current through said coil when said switch is open and power is supplied to said coil through said resistor.

18. The method of claim 11, wherein said coil consumes at least 30% less power when power is supplied to said coil through said resistor then would be consumed if power were applied directly to said coil.

19. The method of claim 11, further including:

when said power is supplied from direct current power source, inhibiting arcing of contacts of said switch by discharging current to ground through a diode connected between said switch and ground.

20. The method of claim 11, wherein a resistance value of said resistor is selected to maintain said actuator in the actuated state without chatter when power is supplied through said resistor and said switch is open.

21. The device of claim 7, wherein an anode of diode is connected to said first end of said coil and to said first contact an a cathode of said diode to connected to said second end of said coil, to said first end of said resistor and to said first side of said switch.

22. The device of claim 1, wherein said switch is a single pole single throw switch.

23. The device of claim 1, wherein:

said switch comprises a rigid contact strip having a first contact bump and a flexible contact strip having a second contact bump, said first and second contact bumps facing each other;

said armature configured to move said flexible strip away from said rigid strip when said coil is powered; and said first and second contact bumps are in physical in contact when said switch is in an open position and are held apart when said switch is in a closed position.

24. The method of claim 11, the electro-mechanical actuator further including:

a diode connected in parallel with said coil.

25. The method of claim 24, wherein an anode of diode is connected to said first end of said coil and to said first contact an a cathode of said diode to connected to said second end of said coil, to said first end of said resistor and to said first side of said switch.

26. The method of claim 11, wherein said switch is a single pole single throw switch.

* * * * *